US007758269B2

(12) United States Patent
Bailey et al.

(10) Patent No.: US 7,758,269 B2
(45) Date of Patent: Jul. 20, 2010

(54) COSMETIC PRODUCT APPLICATOR FOR APPLICATION BY ELECTROSTATIC DEPOSIT

(75) Inventors: William John Bailey, Cheltenham (GB); Fabrice Dieudonat, Fosses (FR)

(73) Assignee: Alcan Packaging Beauty Services, Gennevilliers (FR)

( * ) Notice: Subject to any disclaimer, the term of this patent is extended or adjusted under 35 U.S.C. 154(b) by 532 days.

(21) Appl. No.: 11/696,530

(22) Filed: Apr. 4, 2007

(65) Prior Publication Data

US 2008/0053471 A1 Mar. 6, 2008

(51) Int. Cl.
*A46B 11/00* (2006.01)

(52) U.S. Cl. ..... 401/129; 401/126; 401/118; 132/216; 132/218

(58) Field of Classification Search ..... 401/126, 401/127, 129, 195; 132/207, 901, 218, 216; 118/620, 621, 623; 8/444
See application file for complete search history.

(56) References Cited

U.S. PATENT DOCUMENTS 3,526,234 A * 9/1970 Chrablow ..... 132/204
5,472,456 A * 12/1995 Larsky et al. ..... 132/207
5,569,368 A * 10/1996 Larsky et al. ..... 204/600
6,994,733 B2 * 2/2006 Bartolone et al. ..... 132/207
2005/0031400 A1 * 2/2005 Marcotte et al. ..... 401/129
2005/0286966 A1 * 12/2005 Gueret ..... 401/130

FOREIGN PATENT DOCUMENTS

EP 0933039 A1 8/1999
JP 2000236932 A 9/2000
WO 9620692 A1 7/1996

OTHER PUBLICATIONS

Search Report and Written Opinion dated Feb. 2, 2007 in French Application No. 06/03032.

* cited by examiner

*Primary Examiner*—David J. Walczak
*Assistant Examiner*—Keegan Gumbs
(74) *Attorney, Agent, or Firm*—Banner & Witcoff, Ltd.

(57) ABSTRACT

The applicator (1) intended for the application of a cosmetic product, such as mascara, on a part (20) of the human body (2), has an axial direction (10) and is characterized in that it comprises a device (6) for transferring the cosmetic product towards the part (20) of the human body, the device (6) being manually operable and allowing to produce an electrical field when applying the cosmetic product.

Advantages: facilitates transfer of the product during its application, improves the ergonomics of the application.

26 Claims, 5 Drawing Sheets

COSMETIC PRODUCT APPLICATOR FOR APPLICATION BY ELECTROSTATIC DEPOSIT

BACKGROUND OF THE INVENTION (a) Field of the Invention

The invention concerns the field of applicators for fluid or pasty products, typically applicators for cosmetic products, such as mascara.

(b) Description of the Prior Art

A large number of mascara applicators are already known.

These applicators, which are adapted to operate jointly with a container forming a reservoir for mascara, typically comprise:

a) a cap adapted to seal said container and to be used as a means for prehension of said applicator, b) an axial rod, c) and an applying means.

The applying means may consist of a brush, the rod being fixed to the cap at one of its ends and to the brush at the other end thereof, the brush comprising a metallic twist fixedly holding a plurality of bristles.

With respect to the brush, a large number of types of brushes are already known.

Thus, known are the brushes described in French Patents FR 2 505 633, FR 2 605 505, FR 2 607 372, FR 2 607 373, FR 2 627 068, FR 2 627 363, FR 2 637 471, FR 2 637 472, FR 2 650 162, FR 2 663 826, FR 2 668 905, FR 2 675 355, FR 2 685 859, FR 2 690 318, FR 2 701 198, FR 2 706 749, FR 2 715 038, FR 2 745 481, FR 2 748 913, FR 2 749 489, FR 2 749 490, FR 2 753 614, FR 2 755 593, FR 2 774 269, FR 2 796 531, FR 2 796 532, FR 2 800 586.

Also known are the brushes described in U.S. Pat. Nos. 4,733,425, 4,861,179, 5,357,987, 5,595,198, 6,241,411, 6,427,700.

The applying means may also be made of a molded member of plastic material, as illustrated in French Patent 2 868 264 in the name of the Applicant.

Problems Raised

On the one hand, in view of the permanent evolution of mascara compositions, new applicators must be provided to allow for the application of these compositions, and which are typically adapted for each new composition.

On the other hand, for the users, there is also the necessity to be provided with a wide range of applicators in order to obtain different make-up effects, for example different levels of content of the applicator with the product to be applied and/or different effects when combing the eyelashes.

In addition, more and more it is required to incorporate new technical functions in the applicators, to answer the needs of the users, as well as to provide a distinction with "bottom-of-the-line" products whose production may be relocated to countries where labor cost is low.

Moreover, it is important to ease the manual steps involved with the make-up and to improve its ergonomics.

Finally, in the field of cosmetic products, there is a permanent demand for new products, for example in order to personalize the products, whether we are concerned with compositions, applicators or also wrappings in general, to the extent that replacement of the products becomes an absolute commercial necessity, otherwise one will disappear from the market.

SUMMARY OF THE INVENTION

According to the invention, the applicator adapted for applying a cosmetic product, such as mascara, on a part of the human body, has an axial direction and comprises:

a) a manual prehension means, b) an axial rod oriented along the axial direction, c) an applying means, the axial rod being fixedly connected to the manual prehension means at its so-called upper end, and to the applying means at its so-called lower end, and is characterized in that it comprises a device for transferring the cosmetic product towards the above-mentioned part of the human body, disposed at least in part in the manual prehension means. The device is manually operable and allows to produce an electrical field between the applying means and the above part of the human body when applying the cosmetic product on the above part of the human body, by formation of an electrical circuit that travels through the human body between the hand catching the manual prehension means and the above part of the human body.

This applicator solves the problems raised. Indeed, the transfer device which is associated with this applicator makes it possible:

on the one hand, to use all sorts of compositions of cosmetic products which may vary in a wide range of viscosity, on the other hand, when the device is manually operated, to obtain make-up effects which are different than those obtained with traditional applicators, the applicator according to the invention making it possible to obtain traditional effects when the device is not in operation, in addition, to thus provide the applicators with new technical functions which answer the needs of users, and which distinguish the applicators according to the invention from the so-called "bottom of the line" applicators, moreover, to ease the manual steps involved during make-up and to improve its ergonomics, and finally, to contribute to satisfy the permanent demand for new products, in order for example to personalize the products.

BRIEF DESCRIPTION OF THE DRAWINGS

All the figures relate to the invention.

DESCRIPTION OF PREFERRED EMBODIMENTS

Figure 1:
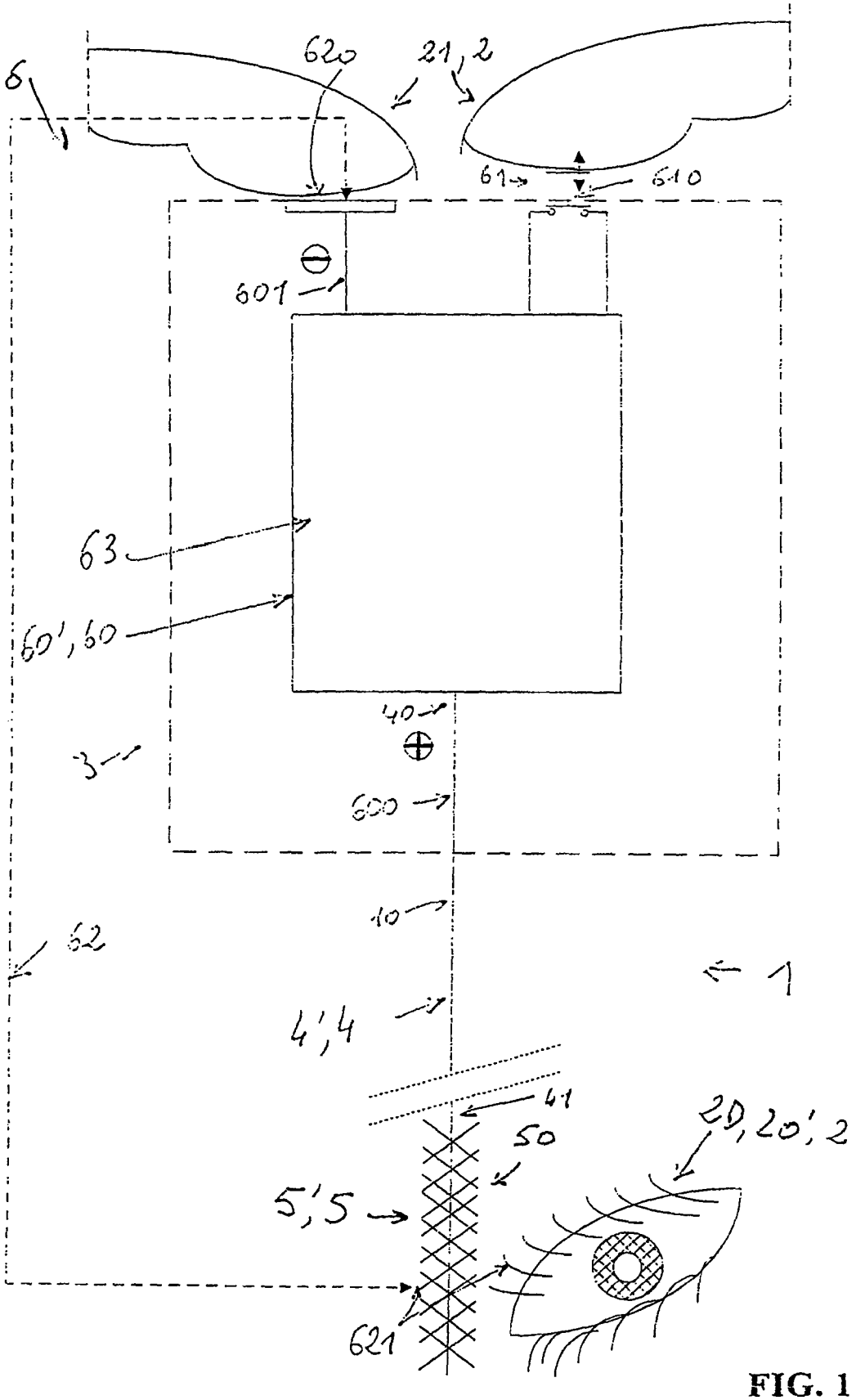
FIG. 1 is a schematic view of an applicator 1 according to the invention, represented when it is in use, applicator 1 comprising a manual prehension means 3, a transfer device 6 comprising a voltage generator 60 which is manually operable and is disposed in the manual prehension means, an axial rod 4 and an applying means 5. The manual prehension means 3 has been illustrated when in contact with fingers 21, while applying means 5 has been illustrated while in contact with eyelashes 20,20' on which make-up is to be applied, in a manner to constitute a closed external electrical circuit 62.

According to an embodiment of the invention, and as illustrated in FIG. 1:

a) the manual prehension means 3 may comprise an outer shell 30, typically an electrically conductive shell 30', b) the axial rod 4 may be an electrically conductive axial rod 4', c) the applying means 5 may, at least in part, be an electrically conductive applying means 5', d) the transfer means 6 may comprise a voltage generator 60 mounted inside outer shell 30, and typically a switch 61 which is manually operable, a terminal 600 of generator 60 being connected to the electrically conductive axial rod 4', and the other terminal 601 being connected to the electrically conductive outer shell 30' or possibly to switch 61, the switch then being in this case an electrically conductive switch 61', in a manner that, when the manual prehension means 3 of applicator 1 is caught by the fingers 21 of a hand of any user of applicator 1, applying means 5 is contacted with that part of the human body 20, for example the face, which is intended to receive the cosmetic product, typically eyelashes, when the product is mascara, an electrical field can be formed between that part of the human body 20 and applying means 5,5', through the external electrical circuit 62 closed by the human body through a so-called upstream contact 620 between finger 21 of the hand and the prehension means 3, and through a so-called downstream contact 621 between that part of the human body 20 and applying means 5,5', the electrical field providing and facilitating a transfer of the product from the applying means 5,5' towards that part of the human body 20.

The electrically conductive axial rod 4' may be selected from: a metallic rod, a molded rod of plastic material which is made electrically conductive at the surface thereof typically by metallization, and an electrically conductive rod of plastic material.

Figure 3:
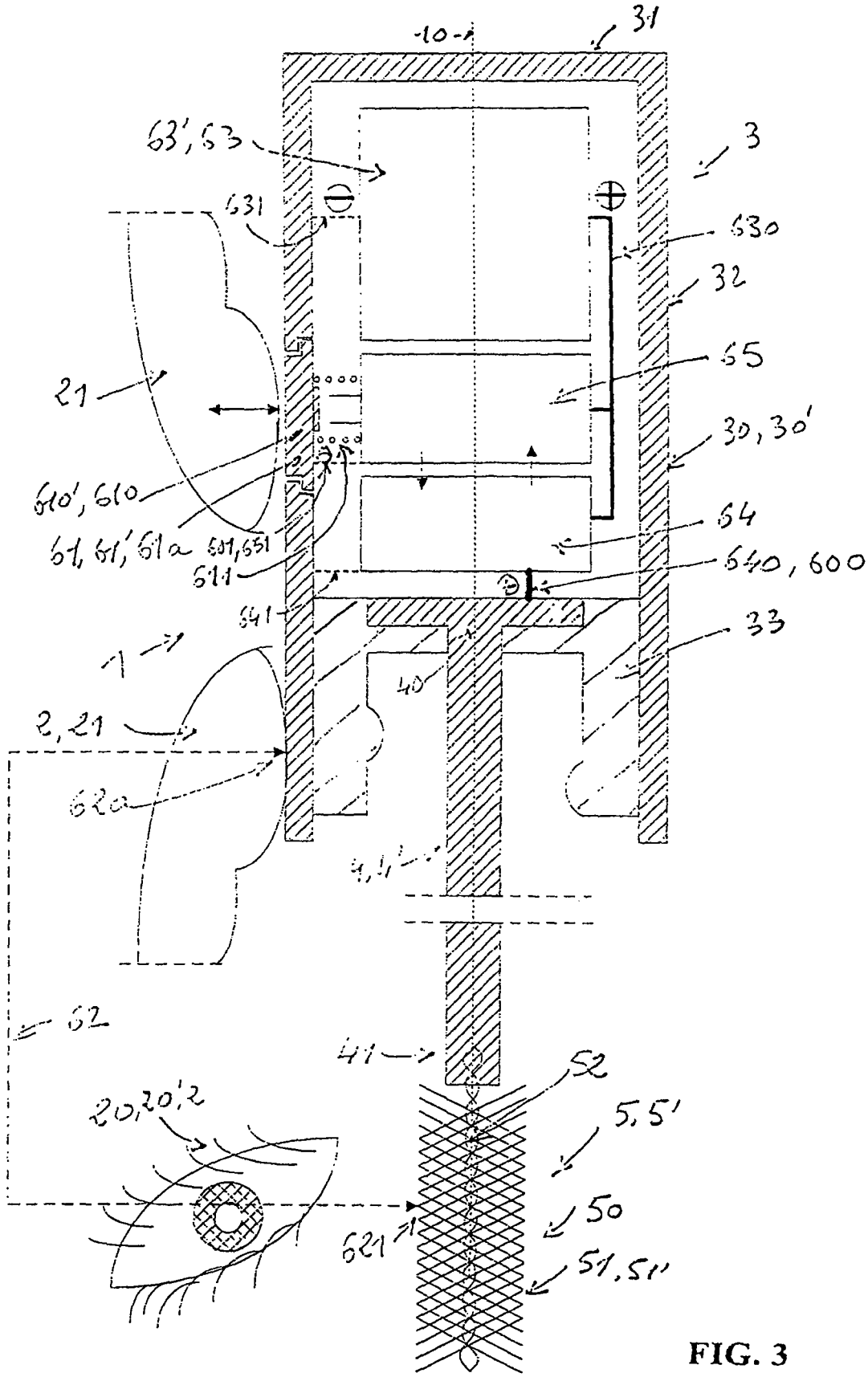
FIG. 3 is axial cross-section view of an applicator 1 taken along axial direction 10, applicator 1 comprising the transfer device 6 according to FIG. 2.
Figure 4:
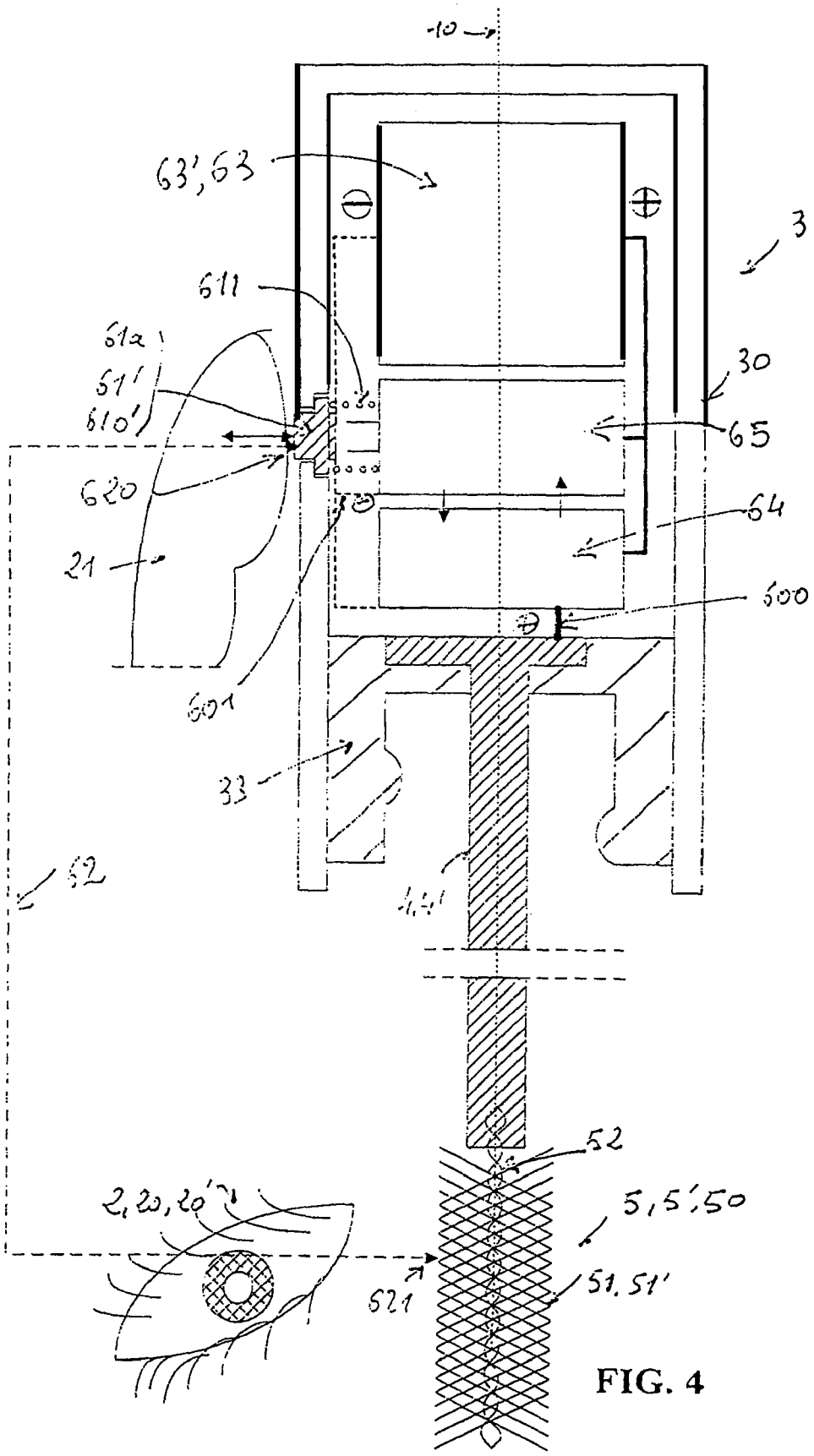
FIG. 4 is similar to FIG. 3 and illustrates an embodiment which is a variant of applicator 1.
Figures 5A, 5B, 5C, 5D:
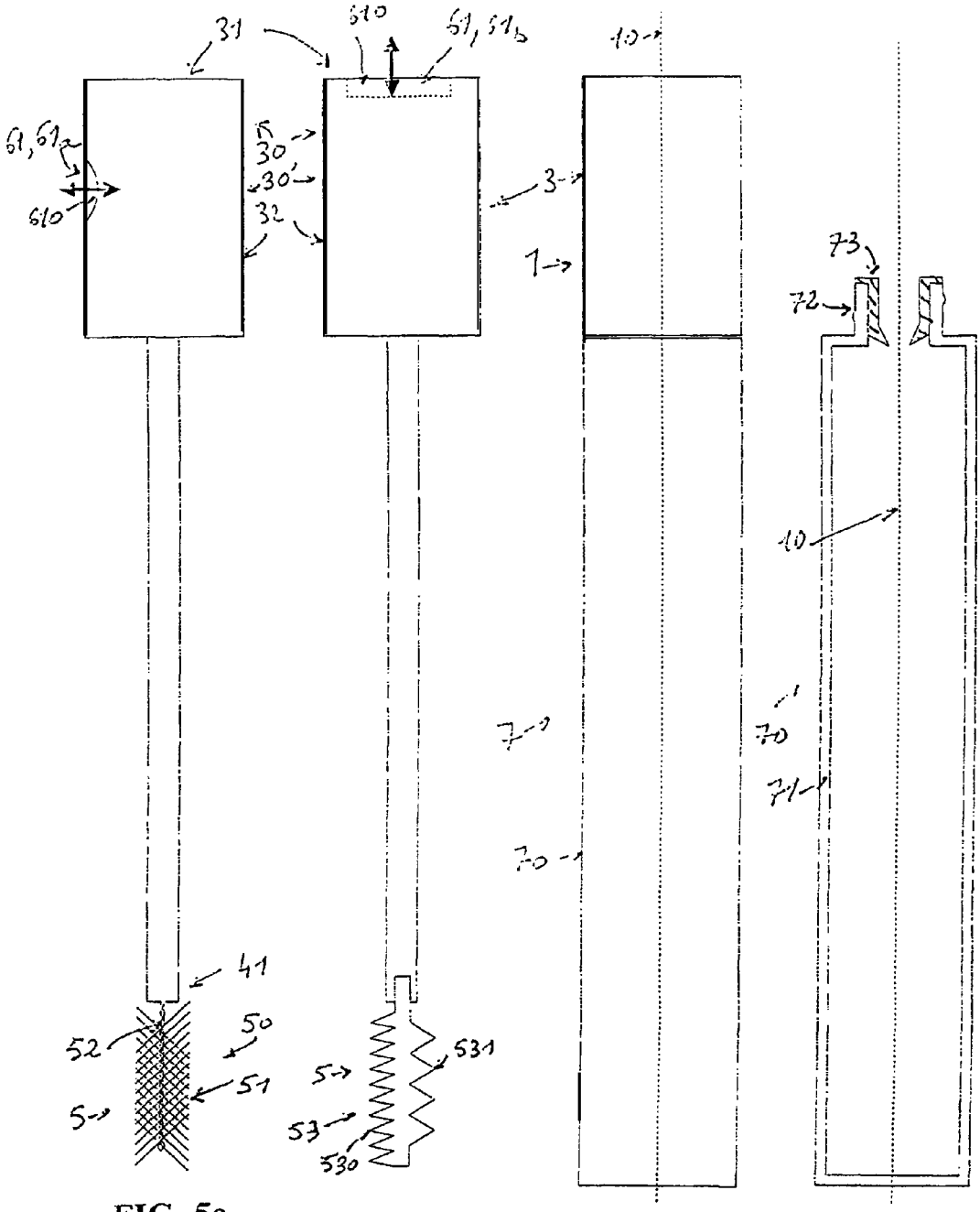
FIG. 5*a* is a side view of an applicator 1 in which the switch 61 of the transfer device 6 is a lateral switch 61*a* mounted on the skirt 32 of outer shell 30, and in which the applying means 5 is a brush 50 comprising a plurality of bristles 51 which are fixed by means of a metallic twist 52 whose upper end is fixed to axial rod 4,4' at its lower end 41.
FIG. 5*b* is similar to FIG. 5*a* and differs therefrom in that the switch 61 of the transfer device 6 is an axial switch 61*b* which is placed on the head 31 of the outer shell 30, and in that the applying means 5 is a molded member of plastic material 53 comprising a plurality of radial projections 531 adapted to catch the product, and an axial series of comb teeth 531 adapted to comb the eyelashes.
FIG. 5*c* is a side view of a closed dispenser 7 comprising a body 70 intended to contain the cosmetic product, and which is sealed by means of applicator 1.
FIG. 5*d* is an axial cross-section view along axial direction 10 of the body 70 of FIG. 5*c*.

According to an embodiment of applicator 1 illustrated in FIGS. 3, 4 and 5*a*, the applying means 5,5' may be made of a brush 50 comprising a plurality of bristles 51 which are fixedly mounted on a central metallic twist 52, the metallic twist being fixed to the axial rod 4,4' at its lower end 41.

The plurality of bristles 51 may be a plurality of electrically conductive bristles 51'.

The plurality of electrically conductive bristles 51' may be prepared by metallization of non electrically conductive bristles.

Eventually, the plurality of electrically conductive bristles 51' may be prepared from a plurality of electrically conductive fibers which are cut in length.

According to another embodiment of applicator 1 illustrated in FIG. 5*b*, the applying means 5,5' may comprise a molded member of electrically conductive plastic material 53, the molded member 53 typically comprising a plurality of radial projections 530 adapted to catch the product.

The electrically conductive molded member 53 may be prepared by metallization of a non electrically conductive member of plastic material.

Eventually, the electrically conductive molded member 53 may be prepared by molding an electrically conductive member of plastic material.

Typically, the means for manual prehension 3 may comprise the manually operable switch 61,61', in a manner to be able to activate/disable the transfer device 6, switch 61,61' comprising a movable member 610, typically an electrical contact guide which is accessible to the hand and thus can be manually moved, possibly when the product is applied on that part of the human body.

As illustrated in FIGS. 3, 4, 5*a* and 5*b*, prehension means 3, typically outer shell 30,30', may comprise a head 31 and a lateral skirt 32.

As illustrated in FIG. 5*a*, switch 61,61' may be a lateral switch 61*a* in which the movable member 610 is disposed on skirt 32 of the manual prehension means 3.

As illustrated in FIG. 5*b*, switch 61,61' may be an axial switch 61*b* in which the movable member 610 is disposed on head 31 of the manual prehension means 3.

Typically, voltage generator 60 is a generator of direct current 60'.

Direct current generator 60' may show a voltage between its terminals, between the plus (+) terminal 600 and the minus (−) terminal, that varies between 300 volts and 1000 volts, and preferably from 500 volts to 800 volts, and typically of 600 volts.

The (+) terminal 600 may be electrically connected to the axial rod 4,4', the (−) terminal being connected to the electrically conductive outer shell 30', in a manner to constitute a ground when any user manually grabs the electrically conductive outer shell 30'.

Figure 2:
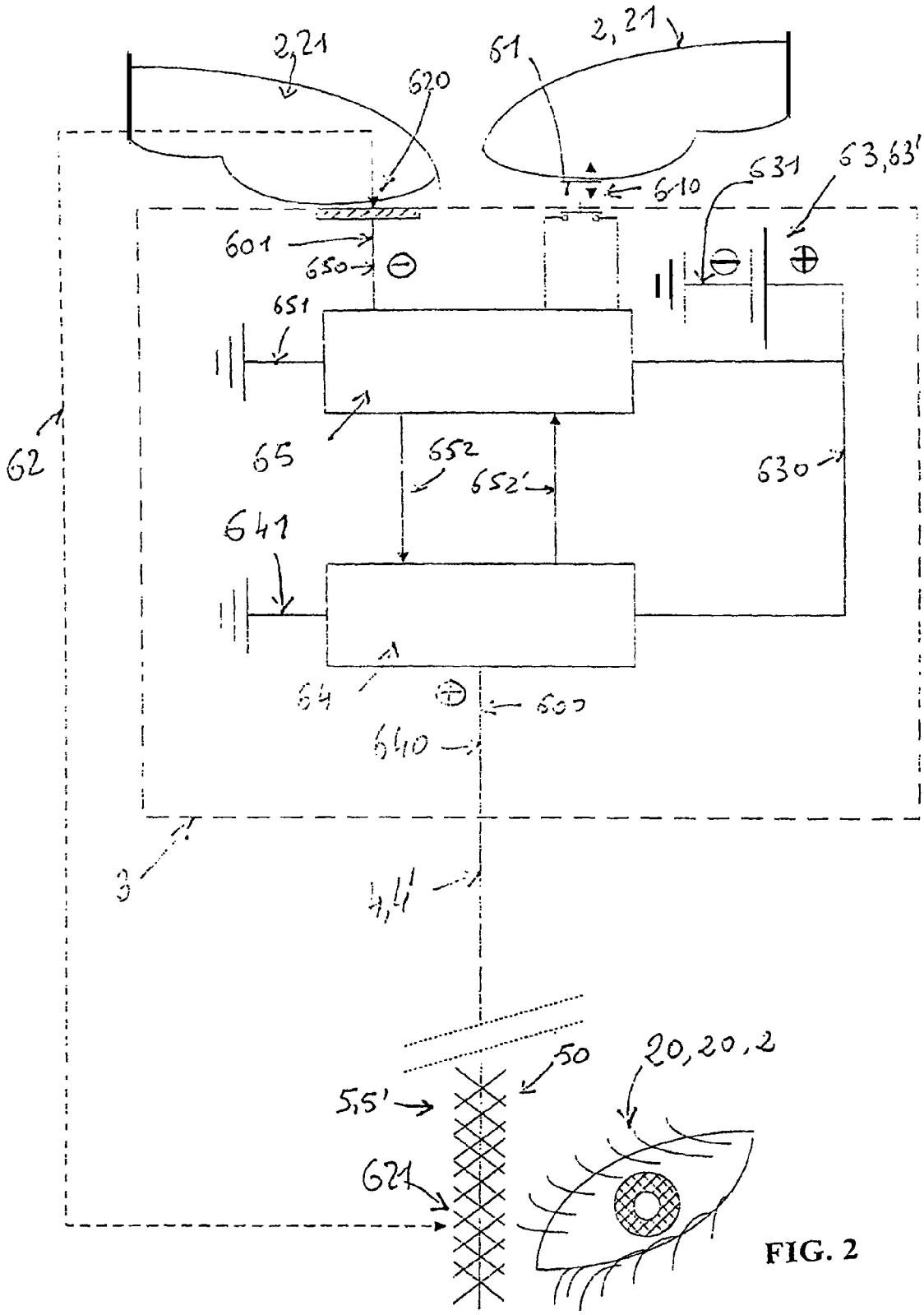
FIG. 2 is similar to FIG. 1 and illustrates a preferred embodiment of transfer device 6 comprising a direct current generator 60', direct current generator 60' comprising for example a supply of low voltage electrical power 63, a high voltage generator 64 fed by supply 63 and a control device 65.

As illustrated in FIGS. 2, 3 and 4, the direct current generator 60' may comprise a supply of low voltage electrical power 63 and a high voltage generator 64 which is fed by the low voltage electrical supply 63, typically consisting of an electrical battery 63 whose voltage varies from 1.5 volt to 24 volts.

Advantageously, the high voltage generator 64 may be associated with a control device 65, typically controlled by means of switch 61, through which an electrical field cannot be produced, on the double condition that the external electrical circuit 62 is closed, the applying means 5,5' being in contact with the part of the human body 20 by producing downstream contact 621, and that switch 61 is manually operated, all this to thus prevent any risk of formation of an electrical arc between the applying means 5,5' and the above part of the human body 20.

For example, control device 65 may comprise a device for measuring the resistance of the external electrical circuit 62, external electrical circuit 62 being considered closed when its resistance is lower that a predetermined resistance value.

As illustrated in FIG. 3, the outer shell 30 may be formed by the electrically conductive outer shell 30'.

The electrically conductive outer shell 30' may be selected from: a metallic shell, a shell molded with plastic material which is made electrically conductive on its surface typically by metallization, and an electrically conductive plastic shell.

As illustrated in FIG. 4, the prehension means 3 may comprise switch 61 which is manually operable through a manual reversible pressure on the movable member 610, typically through a return spring 611, and the movable member 610 may be an electrically conductive movable member 610', all in a manner to constitute upstream contact 620 by simultaneously providing for the closing of the external electrical circuit 62 and an activation of switch 61, outer shell 30 possibly being made of an electrically conductive material.

On FIG. 4, the outer shell 30 is not an electrically conductive outer shell 30'.

According to the invention, the impedance of high voltage generator 64 ranges from 1 to 20 MΩ, i.e. from $10^6$Ω(ohms) to $20.10^6$Ω, and preferably from 5 MΩ to 15 MΩ, and typically 10 MΩ.

Another object of the invention is provided by an applicator dispenser 7 comprising a body 70 defining a container 71 provided with a typically threaded neck 72 comprising a wringer 73, and an applicator 1 according to the invention. The manual prehension means 3 of applicator 1 defines a cap adapted to operate together with neck 72 by screwing, to seal body 70.

In this applicator dispenser 7, container 71 and manual prehension means 3, typically skirt 32 of the manual prehension means 3 may typically have a same exterior cross-section, with a diameter or larger transverse dimension D. In closed position, applicator dispenser 7 has a shape factor H/D at least equal to 4, H being the height of applicator dispenser 7 in closed position thereof.

This common external cross-section may typically be round, oval or square.

EXAMPLES OF EMBODIMENTS

Applicators 1 according to FIGS. 2 to 5*b* were produced.

The electrical sketch of the transfer device 6 that was used has been illustrated in FIG. 2.

This transfer device 6 comprises:

a supply of low voltage electrical power 63, a high voltage generator 64 adapted to produce a voltage of 600 Volts, a control device 65 for the high voltage generator 64, fed with the supply of low voltage electrical power 63, the device being provided with different link terminals, for example with a link 650 defining an upstream contact member 620, and measuring and control links 652,652' connecting control device 65 to high voltage generator 64, a switch 61 comprising a movable member 610 which is manually reachable, and typically a return spring 611.

Control device 65 is used somewhat as a filter between switch 61 and voltage generator 60, typically a high voltage generator 64. Indeed, activation of switch 61 will only power up the axial rod 4,4' if one condition is fulfilled, namely if the applying means 5,5' is in contact with the part of the body 20 on which transfer of the cosmetic product should take place.

Among others, a means to check whether this condition is fulfilled consists in measuring the resistance or the capacitance of the electrical circuit comprising external electrical circuit 62 and the so-called internal electrical circuit comprising electrically conductive axial rod 4' and the electrically conductive applying means 5'.

In the applicator 1 according to FIG. 3, the manual prehension means 3 comprises, as an external shell 30, an electrically conductive exterior shell 30' in which skirt 32 comprises a lateral switch 61*a* provided with a movable member 610 constituting a push button outwardly positioned substantially in the extension of skirt 32.

On this figure, the electrically conductive members 30', 61*a*,4' have been illustrated with the same type of hatching.

The grounding terminals 631,641,651 of the main members 63,64,65 which constitute the transfer device 6 have been connected to the exterior shell 30'.

The manual prehension means 3 comprises an insulating threaded insert 33 constituting an insulating ring which makes it possible to assemble the upper end 40 of rod 4,4' through a manual prehension.

In the applicator 1 according to FIG. 4, which is similar to that of FIG. 3, the exterior shell 30 is not electrically conductive. Only the movable member 610 of switch 61,61',61*a* is an electrically conductive movable member 610', in a manner to thus constitute the upstream contact 620, the grounding terminals 631,641,651 of the main members 63,64,64 which constitute the transfer device 6 then being connected to the electrically conductive movable member 610' .

Applicators 1 according to the embodiments of FIGS. 3 and 4, and according to FIG. 5*a*, were thus produced in which the applying means is a brush 50 and in which the switch 61 is a lateral switch 61*a*. Applicators 1 similar to the preceding ones, were also produced, except that the applying means is a molded member 53 as schematically illustrated in FIG. 5*b*.

Applicators 1 according to the embodiments of FIGS. 3 and 4, and according to FIG. 5*b*, were also produced, in which switch 61 and the applying means constitute a molded member 53 and in which switch 61 is an axial switch 61*b*, the movable member 610 of switch 61 being disposed leveled with head 31. Applicators 1 similar to the preceding ones were also produced, however in this case the applying means is a brush 50.

ADVANTAGES OF THE INVENTION

The applicator 1 according to the invention offers the double possibility, for the user, to simultaneously have at his disposal, a conventional applicator and an applicator with assisted product transfer, through the electrical field provided during application of the product on the selected part of the body, and typically on the eyelashes in the case of mascara.

Potentially, all the already known types of applying means may be rendered electrically conductive through known methods, and they can be used according to the present invention, so that the field of application of the present invention is extremely wide.

List of Parts

Applicator . . . 1
- Axial direction . . . 10

Human body . . . 2
- Part of human body . . . 20
- Eyelashes . . . 20'
- Finger of a hand . . . 21

Means of manual prehension . . . 3
- Outer shell . . . 30
- Electrically conductive shell . . . 30'
- Head of 3, 30, 30' . . . 31
- Skirt of 3, 30, 30' . . . 32
- Typically threaded insulating insert . . . 33

Axial rod . . . 4

Electrically conductive axial rod . . . 4'

Upper end . . . 40
Lower end . . . 41
Applying means . . . 5
Electrically conductive applying means . . . 5'
Brush . . . 50
Plurality of bristles of 50 . . . 51
Plurality of electrically conductive bristles . . . 51'
Metallic twist of 50 . . . 52
Molded member of plastic material . . . 53
Radial projection . . . 530
Comb teeth . . . 531
Transfer device . . . 6
Voltage generator . . . 60
Direct current generator . . . 60'
Terminals of generator . . . 600, 601
(+) Terminal . . . 600
(−) Terminal or ground . . . 601
Switch . . . 61
Electrically conductive switch . . . 61'
Lateral switch . . . 61*a*
Axial switch . . . 61*b*
Movable member . . . 610
Electrically conductive movable member . . . 610'
Return spring . . . 611
External electrical circuit . . . 62
Upstream contact . . . 620
Downstream contact . . . 621
Supply of electrical power of 60' . . . 63
Electrical battery . . . 63'
(+) Terminal . . . 630
(−) Terminal or ground . . . 631
High voltage generator of 60' . . . 64
(+) Terminal . . . 640
(−) Terminal or ground . . . 641
Control device . . . 65
Upstream contact terminal 520 . . . 650
Ground terminal . . . 651
Measuring or control terminal . . . 652, 652'
Applicator dispenser . . . 7
Body . . . 70
Container of 70 . . . 71
Threaded neck . . . 72
Wringer . . . 73

What is claimed is:

1. Applicator adapted for applying a cosmetic product, such as mascara, on a part of the human body, having an axial direction and comprising:

a) a manual prehension means, b) an axial rod oriented along said axial direction, c) an applying means, said axial rod being fixedly connected to said manual prehension means at its so-called upper end, and to said applying means at its so-called lower end wherein the applicator comprises a device for transferring said cosmetic product towards said part of said human body, disposed at least in part in said manual prehension means, said device being manually operable and allowing to produce an electrical field between said applying means and said part of the human body when applying said cosmetic product on said part of the human body by formation of an electrical circuit that travels through said human body between the hand catching the manual prehension means and said part of the human body.

2. Applicator according to claim 1 in which:

a) said manual prehension means comprises an outer shell, typically an electrically conductive shell, b) said axial rod is an electrically conductive axial rod, c) said applying means is, at least in part, an electrically conductive applying means, d) said transfer means comprises a voltage generator disposed inside said outer shell, and typically a switch which is manually operable, a terminal of said generator being connected to said electrically conductive axial rod, and the other terminal being connected to said electrically conductive outer shell or possibly to said switch, said switch then being in this case an electrically conductive switch, in a manner that, when said manual prehension means of said applicator is caught by the fingers of a hand of any user of said applicator, said applying means is contacted with said part of the human body, for example the face, which is intended to receive said cosmetic product, typically eyelashes when said product is a mascara, an electrical field can be formed between said part of the human body and said applying means, through the external electrical circuit closed by said human body through a so-called upstream contact between said finger of said hand and said prehension means, and through a so-called downstream contact between said part of the human body and said applying means, said electrical field providing and facilitating a transfer of said product from said applying means towards said part of the human body.

3. Applicator according to claim 2 in which said electrically conductive axial rod is selected from the group consisting of a metallic rod, a plastic material molded rod which is made electrically conductive at the surface thereof typically by metallization, and an electrically conductive rod of plastic material.

4. Applicator according to claim 1 in which said applying means is made of a brush comprising a plurality of bristles which are fixedly mounted on a central metallic twist, said metallic twist being fixed to said axial rod at the lower end thereof.

5. Applicator according to claim 4 in which said plurality of bristles is a plurality of electrically conductive bristles.

6. Applicator according to claim 5 in which said plurality of electrically conductive bristles is formed by metallization of non electrically conductive bristles.

7. Applicator according to claim 5 in which said plurality of electrically conductive bristles is prepared from a plurality of electrically conductive fibers which are cut in length.

8. Applicator according to claim 1 in which said applying means comprises a molded member of electrically conductive plastic material, said molded member typically comprising a plurality of radial projections adapted to catch said product.

9. Applicator according to claim 8 in which said electrically conductive molded member is prepared by metallization of a non electrically conductive member of plastic material.

10. Applicator according to claim 8 in which said electrically conductive molded member is prepared by molding an electrically conductive member of plastic material.

11. Applicator according to claim 1 in which said means of manual prehension comprises a manually operable switch, in a manner to be able to activate/disable said transfer device, said switch comprising a movable member, typically an electrical contact guide which is accessible to a hand and thus can be manually moved, possibly when said product is applied on said part of the human body.

12. Applicator according to claim 2 in which said prehension means, typically said outer shell, comprises a head and a lateral skirt.

13. Applicator according to claim 12 in which said switch is a lateral switch in which said movable member is disposed on said skirt of said manual prehension means.

14. Applicator according to claim 11 in which said switch is an axial switch in which said movable member is disposed on a head of said manual prehension means.

15. Applicator according to claim 2 in which said voltage generator is a direct current generator.

16. Applicator according to claims 15 in which said direct current generator shows a voltage between its terminals, between the plus (+) terminal and the minus (−) terminal, that varies between 300 volts and 1000 volts.

17. Applicator according to claim 16 in which said (+) terminal is electrically connected to the axial rod, said (−) terminal being connected to said electrically conductive outer shell, in a manner to constitute a ground when any user manually grabs said electrically conductive outer shell.

18. Applicator according to claim 15 in which said direct current generator comprises a source of low voltage electrical power and a high voltage generator which is supplied by said low voltage electrical source, typically consisting of an electrical battery whose voltage varies from 1.5 volt to 24 volts.

19. Applicator according to claim 2 in which said high voltage generator is associated with a control device, typically controlled by means of said switch, through which an electrical field cannot be produced, on the double condition that said external electrical circuit is closed, said applying means being in contact with said part of the human body by producing said downstream contact, and that said switch is manually operated, all this to thus prevent any risk of formation of an electrical arc between said applying means and said part of the human body.

20. Applicator according to claim 19 in which said control device comprises a device for measuring the resistance of said external electrical circuit, said external electrical circuit being considered closed when its resistance is lower that a predetermined resistance value.

21. Applicator according to claim 2 in which said outer shell is formed by said electrically conductive shell.

22. Applicator according to claim 21 in which said electrically conductive shell is selected from the group consisting of a metallic shell, a shell molded with plastic material which is made electrically conductive on its surface typically by metallization, and an electrically conductive plastic shell.

23. Applicator according to claim 2 in which said prehension means comprises said switch which is manually operable through a manual reversible pressure on said movable member, typically through a return spring, and in which said movable member is an electrically conductive movable member, in a manner to define said upstream contact by simultaneously providing for the closing of said external electrical circuit and an activation of said switch, said outer shell possibly being made of an electrically conductive material.

24. Applicator according to claim 2 in which said high voltage generator has an impedance that ranges from 1 to 20 MΩ, i.e. from $10^6\Omega$. (ohms) to $20\times10^6\Omega$.

25. Applicator dispenser comprising a body defining a container provided with a typically threaded neck comprising a wringer, and an applicator according to claim 1, said manual prehension means of said applicator defining a cap adapted to operate together with said neck by screwing, to seal said body.

26. Applicator dispenser according to claims 25, wherein said prehension means comprises a lateral skirt and wherein said container and said manual prehension means, typically said lateral skirt of said manual prehension means typically has a same exterior cross-section, with a diameter or larger transverse dimension D, said applicator dispenser when closed having a shape factor H/D at least equal to 4, H being the height of said applicator dispenser in closed position.

* * * * *